United States Patent [19]

Geyer, Jr. et al.

[11] 4,324,751

[45] Apr. 13, 1982

[54] PROCESS FOR PREPARING VISCOSE RAYON

[75] Inventors: Charles J. Geyer, Jr.; Ben E. White, both of Berwyn, Pa.

[73] Assignee: Fiber Associates, Incorporated, Berwyn, Pa.

[21] Appl. No.: 91,147

[22] Filed: Nov. 5, 1979

[51] Int. Cl.[3] ..... B06B 3/00

[52] U.S. Cl. ..... 264/23; 264/39; 264/169; 264/188

[58] Field of Search ..... 264/169, 39, 23, 188; 425/174.2

[56] References Cited

U.S. PATENT DOCUMENTS

| | | | |
|---|---|---|---|
| 2,484,012 | 10/1949 | Calhoun | 264/23 |
| 2,484,013 | 10/1949 | Calhoun | 264/23 |
| 2,484,014 | 10/1949 | Peterson et al. | 264/23 |
| 2,549,179 | 4/1951 | Debauttville | 264/23 |
| 2,745,136 | 5/1956 | Debauttvelle | 264/23 |
| 2,866,256 | 12/1958 | Matlia | 264/23 |
| 2,954,271 | 9/1960 | Cengat | 264/23 |
| 3,619,429 | 11/1971 | Torigai et al. | 425/174.2 |

FOREIGN PATENT DOCUMENTS

| | | | |
|---|---|---|---|
| 46-33404 | 9/1971 | Japan | 264/23 |
| 47-51969 | 12/1972 | Japan | 264/188 |
| 49-133613 | 12/1974 | Japan | 264/8 |

*Primary Examiner*—Jay H. Woo
*Attorney, Agent, or Firm*—Austin R. Miller

[57] ABSTRACT

This invention relates to a process for producing crimped yarn or fibers which comprises spinning filaments from a spinning jet into a spinning bath and simultaneously subjecting said material to ultra-sonic sound vibrations so as to impart extremely fine and regular crimps onto said filament formed.

3 Claims, 2 Drawing Figures

PROCESS FOR PREPARING VISCOSE RAYON

BACKGROUND OF THE INVENTION

The present invention relates to the manufacture of cellulose products made by the viscose process and other systems where spinnerets or casting nozzles are required. More particularly, this invention relates to an improvement in the spinning of viscose fibers.

It is very desirable both economically and from quality considerations to create a continuous viscose process from the start of pulp preparation to the final fiber.

The spinning machine itself should be continuous, especially for staple fiber. In fact a staple fiber spinning machine is continuous in concept and design. However, a factor infrequent in the chemistry of the process forces frequent discontinuities which are costly both directly and indirectly. Due to the forced interuptions, the spinning machine is, at best, a psuedocontinuous machine.

The discontinuity commonly occurs at the spinning jet. A rare metal jet through which viscose is extruded and then coagulated into fiber by the acid spinning bath, would not appear to be a cause of process interuption. In spinning alkali-cellulose-xanthate is broken down to cellulose and numerous by-products. Some of the by-products, in particular, various forms of free sulfur and the sulfide ion lead to a great deal of trouble at the jet.

The sulfide ion is the primary cause of trouble. It reacts with the zinc ion which occurs in virtually all modern spinning baths, and probably with the small amount of iron and calcium that appear as trace impurities in the bath. These metallic sulfides form a matrix around and within the individual jet capillaries.

Free sulfur "mud" and cellulose gels adhere to the frame work of the metallic sulfide matrix. As a result the jet capillaries become gradually choked off leading to various degrees of poor quality spinning before the trouble is detected. Eventually the plugging reaches a point where the spinning end breaks down or becomes obviously productively inferior short of shut down so that the end is pulled and the jet removed.

In some types of spinning the jet build-up is such that 100% jet change is required per 24 hours, and from 5–15% change per 24 hours is considered satisfactory.

This state of affairs leads to many undesirable results. That is, (1) Spinning machines must be "overbuilt" since a substantial fraction of ends are effectively out of service at all times.

(2) Substantial quantities of viscose are lost by pulling bad jets and flushing new ones.

(3) Defective product.

(4) Labor expense in pulling, clearing, and replacing jets.

(5) Waste disposal problems of viscose waste at each change.

If a process or device were capable of eliminating the source of jet build up, the spinning process could become truly continuous for each individual spinning end.

SUMMARY OF THE INVENTION

The principal object of the present invention is to provide a means whereby the various by-product compounds of a viscose process will be prevented from adhering to the face of a spinning jet or within the jet capillaries.

The importance of this objective has long been recognized in the industry and a number of remedies have been suggested. To the present all such remedies have been in the form of various additives to the viscose or spinning bath. These additives were anionic in nature, usually oils, and presumably repelled the ions and deposits away from the jet face.

Such compounds may have slowed the rate of jet deposit somewhat, but in no way did the additives eliminate the growth of deposits. The problem may have been alleviated but never eliminated.

If high concentrations of additive oils were used jet build-up may have been stopped, but the yarn properties and spinning characteristics were adversely affected.

Clearly, jet build-up must be solved without affecting the properties of the product or quality of spinning.

The present invention does keep jets completely free of deposits and has no discernible effect on fiber characteristics or adverse effects on spinning. Jets "spin" substantially indefinitely in a clean condition.

It is known that an ultra-sonic wave can break up and disperse precipitates or can detach material adhering to surfaces. Ultra-sonic waves are in fact in use for cleaning viscose jets after they have been removed from service.

The present invention provides a means for transmitting an ultra-sonic vibration at about 20,000 Hz or higher directly to the metallic jet while it is spinning. Paricles will not adhere to a jet surface that vibrates so this build-up of mud, sulfides, etc. never occurs.

Furthermore vibrating the jet at ultrasonic frequency has no effect at all on the fiber or spinning other than keeping the jet clean.

The preferred application of this invention is to conduct the vibration directly from the inducing source to the jet by a metallic conductor.

A further application of this invention involves a different objective altogether, namely achieving a novelty fiber. While ultra-sonic vibration has no discernible effect upon the fiber this is not true if the vibrations are in the audible sonic range, that is, from about 5 vibrations/second to about 3500 vibrations/second.

In this range many novel effects are induced. For example, at some frequencies, depending upon the viscose composition to other spinning variables, the fiber skin will be randomly ruptured leading to a novel crimped fiber. At other frequencies minor perturbations in the fiber surface and interior lead to matte effects or a novel "dull" yarn.

Inhibition of jet encrustation is not so pronounced at frequencies lower than ultrasonic, although there is some effect in this direction.

The invention by proper choice of frequency can produce either permanently clean jets with no change in the fiber properties or production of novel fibers without major improvement in jet performance.

For a better understanding of the invention, reference should be made to the following detailed description thereof, taken in conjunction with the appended claims, and the drawings, in which:

BRIEF DESCRIPTION OF THE DRAWINGS

Turning now to FIG. 1 of the drawings, there is illustrated one particular form of a spinning jet for spinning viscose rayon in a spinning bath. A spinning jet is illustrated comprising cylindrical projections 12 extending above the face of the spinneret at the upper face thereof for spinning a multiplicity of filaments such as of viscose rayon. The entire jet may be supported on supports 14, 14 and has a chamber 16 for the xanthated viscose solution, which is pumped into the chamber 17 and flows uniformly upwardly through the projections 12 in a manner to form uniform filaments F within an acid bath. Viscose is continuously supplied through a pipe 18 and fresh spinning bath solution is supplied to the spinning bath 10 by pipe 24.

The individual filaments are directed substantially vertically upwardly from the spinning bath 10 by means of a circular bar guide 20 and are collected. An electronic oscillator, as represented by member 22, in physical contact with the projections 12, constantly and uniformly transmits sound waves to the metallic jet. As a result of the contact of the electronic oscillator with the projections 12, there is a combination effect on the viscose as it enters the spinning bath and is set. The sound waves, together with the vibration of the projection due to the influence of the electronic oscillator at lower frequencies, causes a series of microcrimps in the filament as it is formed and set.

Figure 1:
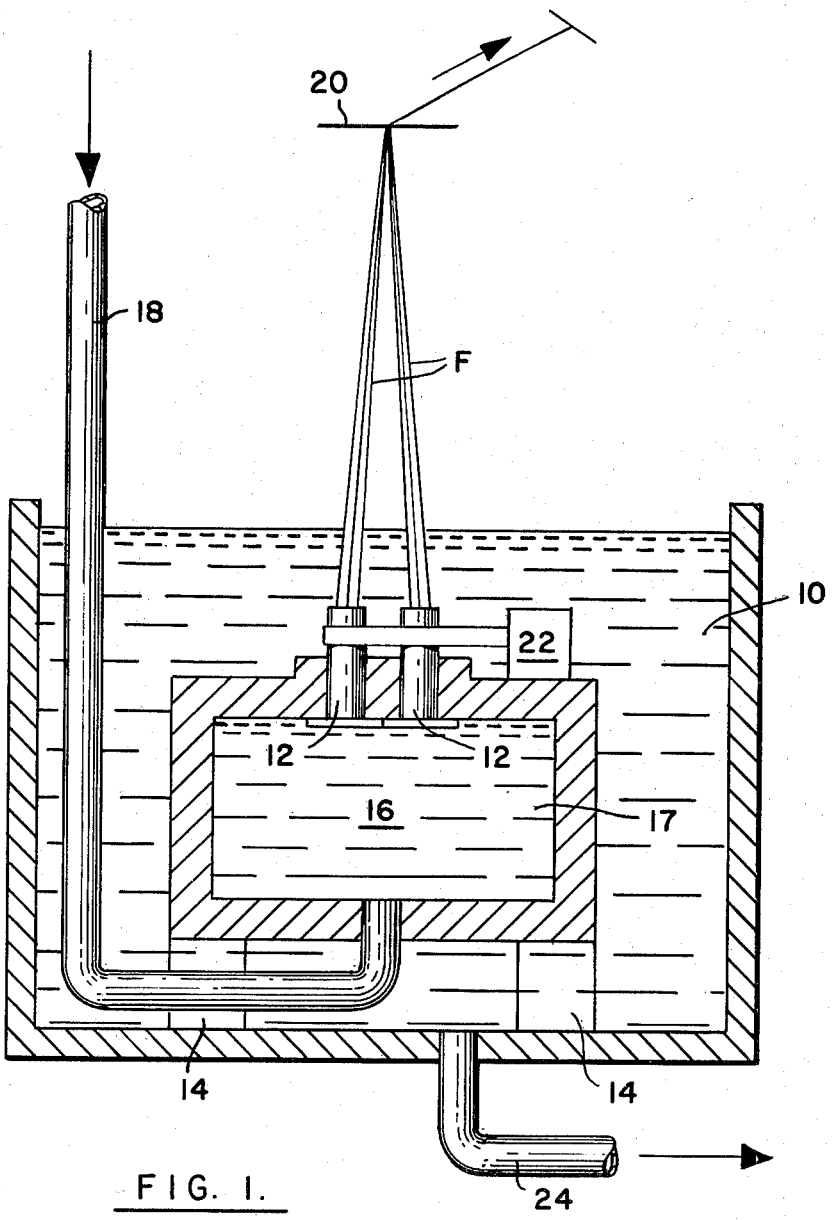
FIG. 1 is a sectional view of a spinning jet with an ultra-sonic device in accordance with the present invention.
Figure 2:
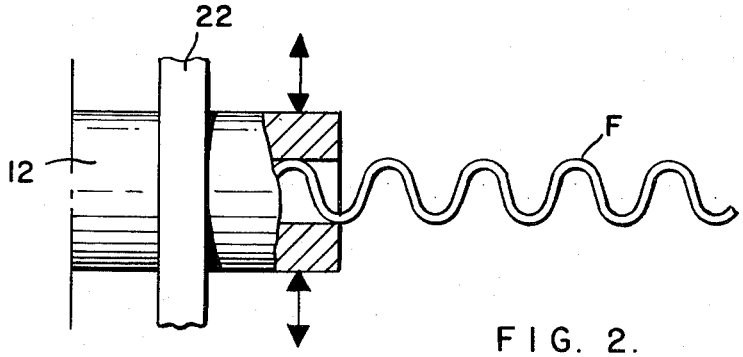
FIG. 2 illustrates the type of crimp which occurs in the filament as it emerges from the spinning jet.

As illustrated in FIG. 2, the crimping is in the form of sound waves because of the positioning of the electronic oscillator or ultra-sonic device and its mechanical waves which are formed as well as the vibration on the jet. It will be appreciated that the form of the oscillations in the filament would be influenced by the direction of vibration on the projections 12 and by the mechanical waves generated by the electronic oscillatory 22 or ultra-sonic device.

It can be further appreciated that the mechanical energy in the bath resulting from the compressions and rarefractions which make up the longitudinal sound waves will prevent any of the microscopic gels or metallic salts from building up. Because of the vibrations on the jet and in the bath, no particles will adhere to the capillary wall or jet face during the spinning operation. As a result, the resultant yarn contains extremely fine and regular crimps of a definite and controllable shape and size along its entire length through the control of both the type and degree of vibration and the frequency of the sound. When the sound frequencies are in the ultra-sonic range, there is little or no effect on the fiber formed. However, there is substantially no adherence of particles or gels on the jet nozzle and capillaries.

While the invention has been described with respect to a select embodiment and example, it should be understood that various minor modifications and adaptations of the process and apparatus of the present invention may be made without departing from the true spirit and scope thereof. For example, while this invention has been illustrated with respect to viscose rayon filaments being formed in a circular upward spinning operation, other synthetic materials may be utilized, and especially where a spinning bath is utilized in order to set the filaments. Accordingly, the appended claims are intended to be construed to cover all such variations and adaptations of the invention which may be made by those skilled in the art without departing from the true spirit and scope thereof.

We claim:

1. A process for removing particle and gel impurities from a jet for spinning viscose rayon filaments which comprise directly contacting said jet with a source of ultrasonic sound of vibrations of at least 20,000 hz so as to remove said impurities by vibration from said jet without altering the filament structure.

2. The process according to claim 1 in which the source of ultrasonic sound is an electronic oscillator.

3. The process according to claim 1 wherein said jet is placed in contact with a source of ultrasonic sound vibrations during spinning of said filaments so as to permit continuous spinning of said filaments while continuously cleaning said jet.

* * * * *